United States Patent [19]

Nishi et al.

[11] Patent Number: 4,806,111

[45] Date of Patent: Feb. 21, 1989

[54] CONNECTOR STRUCTURE

[75] Inventors: Masaaki Nishi, Hachioji; Moritoshi Yasunaga; Ryotaro Kamikawai, both of Tokyo, all of Japan

[73] Assignee: Hitachi, Ltd., Tokyo, Japan

[21] Appl. No.: 925,904

[22] Filed: Nov. 3, 1986

[30] Foreign Application Priority Data

Nov. 1, 1985 [JP] Japan ..... 60-243909

[51] Int. Cl.[4] ..... H01R 3/00

[52] U.S. Cl. ..... 439/109; 439/161; 439/931

[58] Field of Search ..... 439/92, 106, 101, 108, 439/109, 161, 932, 931, 936, 886, 887

[56] References Cited

U.S. PATENT DOCUMENTS

| | | | |
|---|---|---|---|
| 3,337,833 | 8/1967 | Creedon | 439/109 |
| 3,340,491 | 9/1967 | Deakin | 439/931 |
| 4,138,604 | 2/1979 | Harmsen et al. | 439/931 |
| 4,505,532 | 3/1985 | Hine et al. | 439/161 |

OTHER PUBLICATIONS

Bassous et al., Fabrication of Multiprole Miniature Electrical Connector, IBM Tech Bulletin vol. 19 No. 1, June 1976 pp. 372–374.

*Primary Examiner*—Gil Weidenfeld

*Assistant Examiner*—Paula A. Austin

*Attorney, Agent, or Firm*—Antonelli, Terry & Wands

[57] ABSTRACT

A connector structure comprising an electrically conductive plate having a plurality of through holes formed therein, an electrically insulated film formed on the inner wall of at least one of the through holes, an electrically conductive film formed on the inner wall of at least one other through hole, and an electrically conductive material of a low melting point provided within the through holes. The low melting point material provided in the through holes whose inner walls are coated with an electrically insulating film is insulated from the electrically conductive plate and such through holes may serve to receive signal propagating pins. The low melting point material in the through holes whose inner walls are coated with an electrically conductive film are tightly bonded to its inner wall due to the wettability between the low melting point material and the electrically conductive film so that such through holes may serve to receive a common potential pin to electrically stabilize the electrically conductive plate and to reduce electrical capacitance unnecessarily formed between the signal propagating pin receiving through holes. Thus, the connector structure is adapted for a high speed signal transmission without suffering substantial crosstalk noise.

8 Claims, 3 Drawing Sheets

CONNECTOR STRUCTURE

BACKGROUND OF THE INVENTION

The present invention relates to connectors for connecting wiring boards electrically to each other, and more particularly to connector structures for electrically connecting a multiplicity of electrodes which are formed densely on a substrate containing a multiplicity of semiconductor chips such as for constituting a part of a large-scale computer, the connector structures being suited for high-speed pulse transmission.

It has been desired to make an electronic apparatus such as a large-scale computer small in size and high in operating speed. Accordingly, it is strongly desired that a connector structure for electrically connecting substrates present in such an electronic apparatus, be small in size, have a multiplicity of electrodes, and have excellent high-speed pulse transmission characteristics.

In a mechanical connector structure which is used in a large-scale computer and employs a spring contact, problem include the difficulty in making the connector structure small in size maintaining and insertion/extraction force necessary for engaging and disengaging a substrate that is not excessive, particularly when the number of electrodes included therein is large. Further, in the mechanical connector structure, the electric capacitance between electrodes is as high as about 1 pF, and each electrode has an inductance of about 10 nH. Accordingly, the mechanical connector structure is unsuitable for high-speed pulse transmission. Meanwhile, a connector for connecting multi-pin electrodes to each other with a small insertion extraction force is proposed in an article entitled "Fabrication of Multiprobe Miniature Electrical Connector" (IBM Technical Disclosure Bulletin, Vol. 19, No. 1, 1976-6, pages 372 to 374). In this article, it is described that a connector structure which is small in size and requires small insertionextracton force can be formed by silicon lithography, and such connector structure is very useful for testing and packaging electronic circuits.

FIG. 1 shows a cross-section of a connector structure proposed in the above-mentioned article. In FIG. 1, reference numeral 1 designates a receptacle plate, 2 metal blocks having a low melting point, 3 electrode pins, 4 and 4' substrates each provided with electrode pins, and 5 octahedron-shaped through holes formed in the receptacle plate 1. The receptacle plate 1 is formed in such a manner that two silicon plates 1*a* and 1*b* each having truncated tetrahedron-shaped through holes are bonded to each other, and an insulating oxide film 7 is formed on the surface of the plate 1 and the inner wall of each through hole. A pair of facing electrode pins 3 are electrically connected to each other through the low melting point metal piece 2 loaded in the truncated octahedron-shaped through hole 5. When the metal block 2 is heated to temperatures higher than the melting point thereof, the substrates 4 and 4' can be inserted in and extracted from the connector structure with an insertion extraction force substantially equal to zero. Further, the substrates 4 and 4' can be fixed to the connector structure by solidifying the metal block 2 which was in a softened or molten state due to the heating.

For high-speed pulse transmission, however, the above connector structure causes such inconveniences as mentioned below, unless operated at an extremely low temperature. Referring again to FIG. 1, the receptacle plate 1 made of silicon is electrically conductive, unless kept at an extremely low-temperature, and hence the inner wall of each through hole 5 has to be coated with the insulating film 7 to electrically insulate an electrode made up of the low melting point metal block 2 and a pair of electrode pins 3 from the receptacle plate 1. In such a connector structure, the electric capacitance C between adjacent electrodes each made up of the members 2 and 3 is approximately expressed by the following equation:

$$C=(\epsilon S)/(2t) \quad (1)$$

where $\epsilon$ and t indicate the dielectric constant and the thickness of the insulating film 7 formed on the inner wall of each through hole 5, and S indicates an area for which the members 1 and 2 are opposed to each other. For example, when the insulating film 7 has a thickness of 2 $\mu$m, the capacitance C lies in a range from 2 to 3 pF or may be greater than 3 pF which will bring about the problems of large reflection noise and a long delay time. Further, even when adjacent electrodes each made up of the members 2 and 3 are spaced apart from each other to some extent, a capacitor is formed between adjacent electrodes with a portion of the conductive receptacle plate 1 being interposed between adjacent electrodes, and thus the capacitance between adjacent electrodes does not decrease. Accordingly, there arised another problem that, crosstalk noise is increased. Further, since the reflection noise and the crosstalk noise are inversely proportional to the rising (or falling) time of a pulse signal to be transmitted, the transition speed of the pulse signal has to be limited to reduce each of the reflection noise and crosstalk noise to an allowable level.

SUMMARY OF THE INVENTION

It is an object of the present invention to provide a high density multi-electrode connector structure which can engage and disengage a substrate with and from another similar one with a small insertion extraction force, the substrate having a plurality of semiconductor chips containing semiconductor devices and others, and which is excellent in high-speed pulse transmission characteristics.

In order to attain the above object, according to one aspect of the present invention, there is provided a connector structure in which each of through holes formed in an electrically conductive plate is loaded with a low melting point metal block, the low melting point metal block is solidified melted so that a substrate provided with a multiplicity of electrodes can be detachably mounted on another substrate or on a wiring board provided with a multiplicity of electrodes with a weak insertion extraction force, and the inner wall of at least one of the through holes (for example, the inner wall of a through hole for a ground electrode) is not coated with an insulating film and the inner wall of at least one of the remaining through holes (for example, the inner wall of a through hole for a signal propagating electrode) is coated with an insulating film to thereby decrease the electric capacitance between adjacent signal propagating electrodes and the electric capacitance between a signal propagating electrode and an electrode other than a signal propagating electrode, whereby the reflection noise, the crosstalk noise and or a delay time can be reduced.

Further, according to another aspect of the present invention, the inner wall of a through hole of a powering electrode is coated with a thin insulating film or insulating ferroelectric film, and is further coated with a conductive film, to increase the electric capacitance between the ground electrode and the powering electrode, thereby stabilizing electric power supply.

BRIEF DESCRIPTION OF THE DRAWINGS

FIG. 2 shows a wafer substrate assembly which may be used, for example, for part of a large scale computer. Referring to FIG. 2, a substrate 4 is, for example, a silicon wafer containing a multiplicity of IC chips 50. Further, the substrate 4 may be mounted with IC chips fabricated by a process different from that of substrate 4. The substrate 4 has an area of, for example, 100 mm×100 mm, and may be a wafer scale integration circuit unit. An inter-electrode space conversion plate 25 is fixed to a pair of main boards 10. Each main board 10 is formed of, for example, an insulating ceramic plate having a wiring pattern formed thereon. The conversion plate 25 is formed of, for example, an insulating ceramic frame having a wiring pattern formed thereon. The conversion plate 25 receives signals and others from electrode pins formed densely on the substrate 4 through a receptacle plate 11 made of, for example, silicon, and the received signals and others are transmitted to one of the main boards 10 through electrodes arranged on the conversion plate 25 with a spacing between adjacent electrodes greater than the spacing between adjacent electrode pins of the substrate 4. The substrate 4 is detachably mounted on the main boards 10 by making use of guide grooves or guide rails (not shown) provided in or on each main board 10.

The arrangement of the substrate 4, the receptacle plate 11 and the conversion plate 25 can be best seen from FIG. 3, which shows an embodiment of a connector structure according to the present invention and is a sectional view taken along the line III—III of FIG. 2. In FIG. 3, reference character G designates an electrode pin provided on the substrate 4 for supplying a common potential, for example, a ground potential, S an electrode pin provided on the substrate 4 for propagating a signal, and 6G and 6S electrodes provided on an input section of the conversion plate 25. The receptacle plate 11 is made of, for example, silicon, as mentioned above, and hence has a temperature coefficient substantially identical with that of the substrate 4 and is electrically conductive except at very low temperatures. Further, through holes 15G and 15S are formed in the electrically conductive plate 11 so as to correspond to the electrode pins G and S, respectively. Similarly to the receptacle plate 1 of FIG. 1, the electrically conductive plate 11 may be formed by combining a pair of silicon plates **11*a* and 11*b* each having truncated tetrahedron-shaped through holes so that truncated octahedron-shaped through holes 15G and 15S are formed in the electrically conductive plate 11. Alternately, the electrically conductive plate 11 may be formed of a single silicon plate having through holes of the above-mentioned or any other desired shape. The inner wall of, for example, the through hole 15G which receives the common potential electrode pin G and the electrode 6G, is coated with an electrically conductive film 16 to ensure the electrical connection between the electrically conductive plate (namely, the receptacle plate) 11 and a low melting point metal block 12G loaded in the through hole 15G. Further, the inner wall of, for example, the through hole 15S which receives the signal propagating electrode pin S and the electrode 6S, is coated with an insulating film 17 to insulate the electrically conductive plate 11 electrically from the electrode pin S, the electrode 6S and a low melting point metal block 12S loaded in the through hole 15S**.

Figure 1:
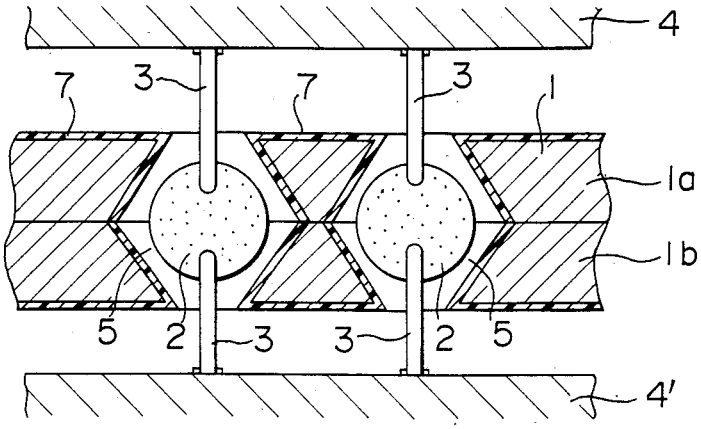
FIG. 1 PRIOR ART
FIG. 1 is a sectional view showing a conventional connector structure.
Figure 2:
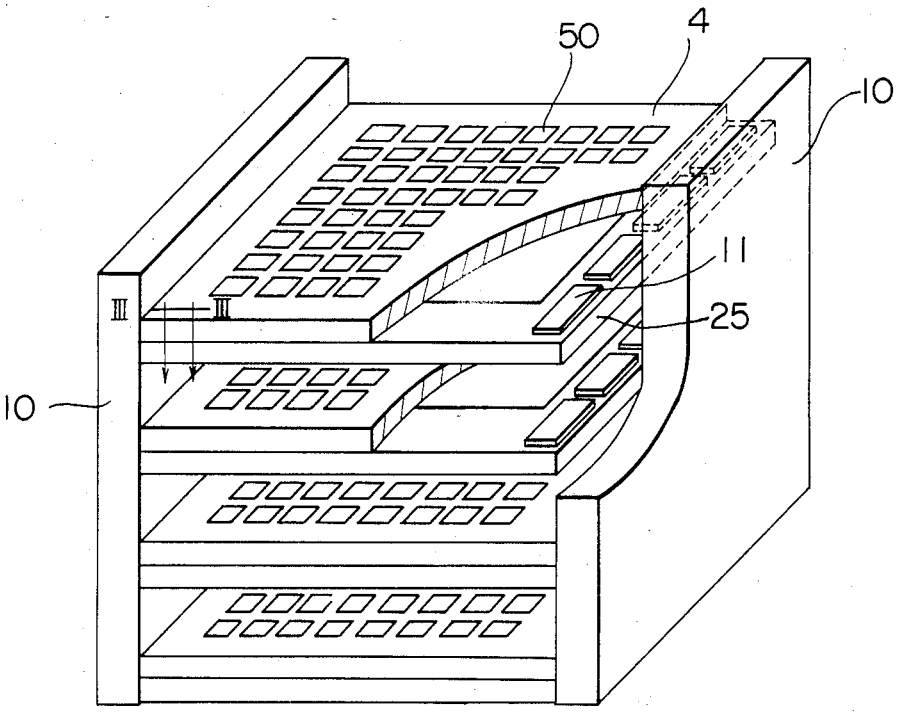
FIG. 2 is a perspective view showing a wafer substrate assembly which includes a plurality of IC substrates, and to which a connector structure according to the present invention is applicable.

In the present embodiment, the conductive film 16 is made of platinum, gold or others, and is deposited by evaporation, electroless plating or a combination of electroless plating and electroplating. Since the conductive film 16 is formed directly on the inner wall of the through hole 15G, the wettability between the low melting point metal block 12G and the conductive film 16 is so good as to ensure the electrical connection between the electrically conductive plate 11 and both of the electrode pin G and the electrode 6G. Thus, the ground electrode pin G and the whole of the electrically conductive plate 11 are kept at the same potential, and the electric capacitance between adjacent signal propagating electrode pins S is reduced by the shielding effect of the electrically conductive plate 11. As a result, the crosstalk noise is greatly reduced. Further, the insulating film 17 is formed all over the surface of the electrically conductive plate 11 excepting a surface area coated with the conductive film 16 by heating the electrically conductive plate 11 to a high temperature after the formation of the conductive film 16. When the electrically conductive plate 11 is kept at the high temperature for a sufficiently long time, the insulating film 17 has a thickness of 5 to 6 μm or more, and the electric capacitance between the signal propagating electrode pin S and the electrically conductive plate 11 can be reduced to a value in a range from 0.5 to 0.6 pF or less. As a result, the reflection noise is greatly reduced. Accordingly, the present embodiment will be excellent in high-speed pulse transmission characteristics. That is, even when a high-speed pulse signal having a rising (or falling) time of 200 to 300 ps or less can be transmitted or propagated with very low reflection noise and low crosstalk noise. Similarly to the connector structure of FIG. 1, the substrate 4 can be inserted in or extracted from the mating wiring board with an insertion extraction force substantially equal to zero. This substantially zero insertion extraction force holds for all of the following embodiments.

Figure 3:
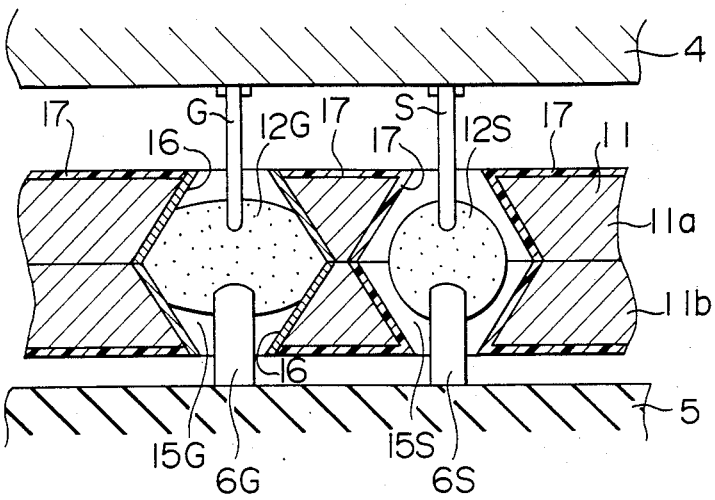
FIG. 3 is a view taken along line III—III of FIG. 2 and shows a connector structure according to the present invention.
Figure 4:
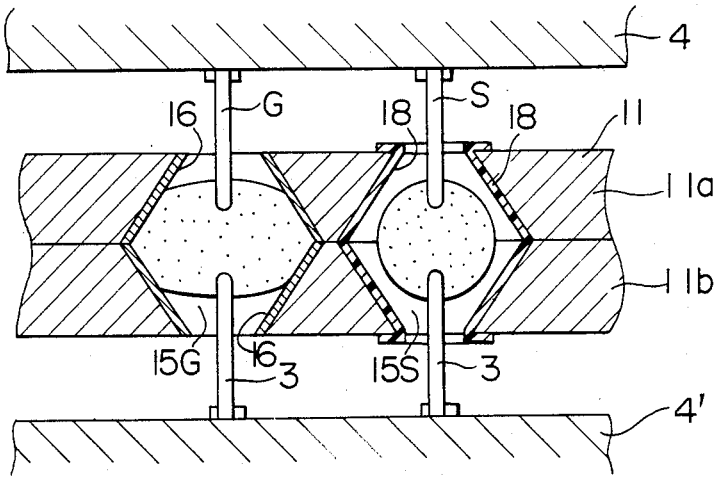
FIG. 4 is a view similar to FIG. 3 of another embodiment wherein the insulating material is made of a high molecular compound.

FIG. 4 shows another embodiment of a connector structure according to the present invention, in which the embodiment shows an insulating film made of a high molecular compound is substituted for the silicon oxide film 17 on the inner wall of the through hole 15S. Further, FIG. 4 shows a case where the substrate 4 is connected to another similar substrate 4'. Reference numeral 18 in FIG. 4 designates an insulating film which is made of a high molecular compound, for example, polyparaxylene, and is deposited by the evaporation method sing a mask. In FIG. 4, the same reference numerals and characters as in FIG. 3 designate like parts. It is easy to form the insulating polymer film 18 having a thickness of 10 to 60 μm. Accordingly, the electric capacitance between the signal propagating electrode pin S and the electrically conductive plate 11 can be made smaller as compared with that in the embodiment of FIG. 3. Thus, the reflection noise and the crosstalk noise are suppressed more effectively, and the high-speed pulse transmission characteristics are more improved.

In the present embodiment, since the insulating film 18 on the inner wall of the through hole 15S is not formed by thermal oxidation, but is formed by the deposition of a high molecular compound, an insulating silicon oxide film is not formed on the surface of the electrically conductive plate 11, unlike the embodiment of FIG. 3. However, the surface of the electrically conductive plate 11 may be coated with the insulating polymer film. The polymer film is required to have the following characteristics: mechanical characteristics that a pinhole or crack is not formed in the polymer film, thermal characteristics that the polymer film does not decompose at the melting point of the low melting point metal blocks (namely, at a temperature of 150° to 200° C.), and electrical characteristics that the polymer film has a small dielectric constant (namely, a dielectric constant of 2 to 4).

Figure 5:
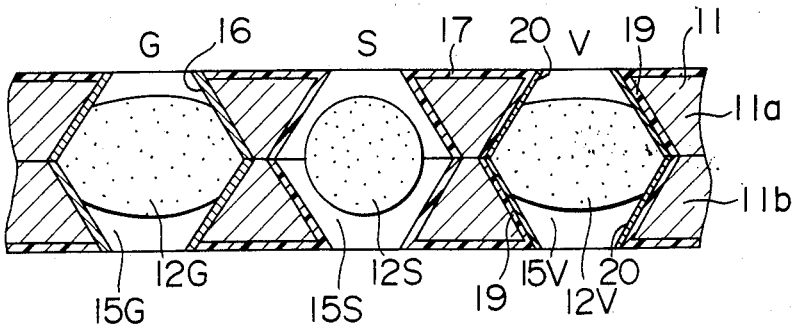
FIG. 5 is a view of a conductive plate of yet another embodiment of the present invention having an insulating ferromagnetic film formed on the inner wall of a hole.

FIG. 5 shows a further embodiment of a connector structure according to the present invention. In FIGS. 3 and 4, electric power is supplied from the substrate 4 to the conversion plate 25 or substrate 4' through a power supply system separated from the connector structure. In FIG. 5, however, electric power is supplied from a substrate to another substrate or a conversion plate through the connector structure. It is to be noted that the above substrates and conversion plate are omitted from FIG. 5 for brevity's sake. It should be understood that reference characters G and S in FIG. 5 indicate that the same electrode pins G and S as in FIGS. 3 and 4 are embedded in the low melting point metal blocks 12G and 12S, respectively. Further, it should be understood that reference character V in FIG. 5 indicates that an electrode pin V similar to the electrode pins G and S is embedded in a low melting point metal block 12V. The electrode pin V is used for transmitting electric power, that is, is used as a powering electrode pin. An insulating ferroelectric film 19 is formed on the inner wall of a through hole 15V which receives the electrode pin V, and a conductive film 20 is formed on the ferroelectric film 19 for the purpose of insulating the electrode pin V electrically from the electrically conductive plate 11 and for the purpose mentioned later. In FIG. 5, the same reference numerals as in FIGS. 3 and 4 designate like parts. That is, in the present embodiment, the inner walls of the through holes 15G and 15S which receive the ground electrode pin G and the signal propagating electrode pin S, respectively, are treated in the same manner as in the embodiment of FIG. 3. Prior to formation of the insulating silicon oxide film 17, the insulating ferroelectric film 19 is formed by sputtering a ferroelectric material such as lead titanate or by other methods. The conductive film 20 is formed by evaporating platinum, gold, or others.

Each of the powering electrode pin V and the ground electrode pin G has some inductance. Accordingly, when a current flowing through one of the electrode pins G and V varies abruptly and greatly, the potential difference between the electrode pins G and V changes during the time period in which the above current is varied. In order to absorb and suppress the above change in potential difference for stabilized power supply to another substrate or a conversion plate stably, it is necessary to make the electric capacitance between the electrode pins G and V sufficiently large. For this purpose, the conductive film 20 is formed on the insulating ferroelectric film 19, and a capacitor is formed between the conductive film 19 and the electrically conductive plate 11, whereby the electric capacitance between the electrode pins G and V can be readily made equal to 1,000 pF or more. Thus, according to the present embodiment, electric power can be supplied stably. The thickness of the insulating ferroelectric film 19 is made as small as possible, as long as the dielectric breakdown of the film 19 due to a source voltage does not occur. The insulating film 19 may be formed of, instead of ferroelectric material, a silicon oxide film having a thickness of about 0.2 μm. Such a silicon oxide film can be formed by maintaining the electrically conductive plate 11 at a high temperature for a short time. Further, the silicon oxide film 17 in FIG. 5 may be replaced by an insulating polymer film or the laminate of an insulating silicon oxide film and an insulating polymer film. In this embodiment, since the conductive film 20 is formed on the ferroelectric film 19, the wettability between the low melting point metal block 12V and the inner wall of the through, hole 15V is so good, and moreover, the conductive film 20 is so close to the electrically conductive plate 11, that the electric capacitance between the electrode pin V and the electrically conductive plate 11 is large enough to give a stable power supply.

Figure 6:
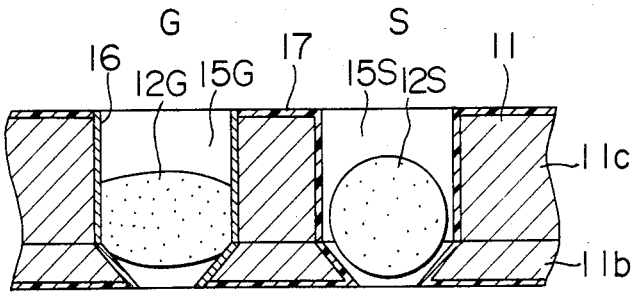
FIG. 6 is a view of a further embodiment where the thickness of one conductive plate is smaller than the thickness of the other conductive plate.
Figure 7:
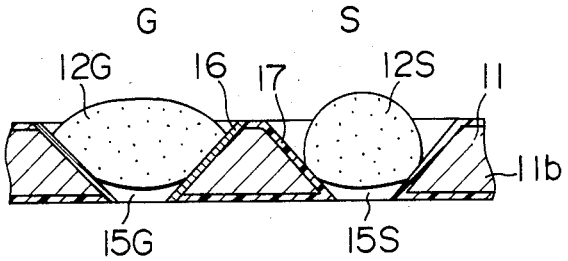
FIG. 7 is a view of yet a further embodiment wherein the conductive plate is a unitary member.

FIGS. 6 and 7 show still other embodiments of a connector structure according to the present invention, in which embodiments through holes have a shape different from those of the through holes 15G and 15S of FIGS. 3 and 4. Although a powering electrode pin is not included in the embodiments of FIGS. 6 and 7, an additional through hole having the same shape as the through holes shown in FIG. 6 or 7 may be formed in the embodiments of FIGS. 6 and 7 to receive the above powering electrode pin. In FIGS. 6 and 7, the same reference numerals and characters as in FIGS. 3 to 5 designate like parts. The substrate and conversion plate which are shown in FIGS. 3 and 4 are omitted from FIGS. 6 and 7 for the sake of simplicity. In the embodiments of FIGS. 6 and 7, the inner walls of the through holes 15G and 15S which receive the ground electrode pin G and the signal propagating electrode pin S, respectively are treated in the same manner as in the embodiment of FIG. 3 or 4. Further, a through hole for receiving a powering electrode pin may be additionally formed in the conductive plate 11 shown in FIG. 6 or 7, the inner wall of the additionally formed through hole being treated in the same manner as described with reference to FIG. 5.

The low melting point metal blocks 12G, 12S and 12V in the above embodiments may be made of the same material. In this case, these metal pieces have different shapes, depending upon the wettability between the above material and the film formed on the inner wall of through holes.

As has been explained in the foregoing, according to the present invention, a connector structure can be obtained which is excellent in high-speed pulse transmission characteristics.

We claim:

1. A connector structure comprising:

an electrically conductive plate having a plurality of through holes formed therein;

an electrically insulating film formed on the inner wall of at least one of said plurality of through holes with at least one of said plurality of through holes being not covered with an electrically insulating film;

an electrically conductive film formed on the inner wall of at least one of the through holes which is not covered with an electrically insulating film.

2. A connector structure according to claim 1, in which the thickness of the insulating film on the inner wall of at least one of the through holes is less than $\frac{1}{3}$ as that of the insulating film on the inner wall of other through holes.

3. A connector structure according to claim 1, in which at least one of the electrically insulating film on the inner wall of through holes is a ferroelectric film.

4. A connector structure according to claim 1, in which said electrically conductive material is a low melting point metal.

5. A connector structure according to claim 1, in which said electrically insulating film on the inner wall of through holes is an oxide film.

6. A connector structure according to claim 1, in which said electrically insulating film on the inner wall of through hole said at least one is made of a high molecular compound.

7. A connector structure comprising:

an electrically conductive plate having a plurality of through holes formed therein;

an electrically insulating film formed on the inner wall of at least one of said plurality of through holes with at least one of said plurality of through holes being not covered with an electrically insulating film;

an electrically conductive material provided within at least one of those of said plurality of through holes; and an electrically conductive film formed on at least one of the electrically insulating film on the inner wall of through holes.

8. A connector structure comprising:

an electrically conductive plate made of a material having a temperature coefficient substantially identical with that of a semiconductor substrate in which semiconductor devices may be formed, said plate having a plurality of through holes formed therein;

an electrically insulating film formed on the inner wall of at least one of said plurality of through holes with at least one of said plurality of through holes being not covered with an electrically insulating film; and an electrically conductive material provided within at least one of those of said plurality of through holes.

* * * * *